US009708150B2

(12) United States Patent
Braschoss et al.

(10) Patent No.: US 9,708,150 B2
(45) Date of Patent: Jul. 18, 2017

(54) SYSTEM AND METHOD FOR FOLDING PRINTED SHEETS

(71) Applicant: Mueller Martini Holding AG, Hergiswil (CH)

(72) Inventors: Peter Braschoss, Zofingen (CH); Hanspeter Duss, Buchs (CH); Christoph Gysin, Ormalingen (CH); Martin Thurnherr, Nebikon (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 857 days.

(21) Appl. No.: 14/067,833

(22) Filed: Oct. 30, 2013

(65) Prior Publication Data

US 2014/0117608 A1 May 1, 2014

(30) Foreign Application Priority Data

Oct. 30, 2012 (CH) ..... 2179/12

(51) Int. Cl.

| | |
|---|---|
| ***B65H 45/12*** | (2006.01) |
| ***B41F 13/56*** | (2006.01) |
| ***B65H 45/04*** | (2006.01) |
| *B31B 1/52* | (2006.01) |
| *B65H 45/18* | (2006.01) |

(52) U.S. Cl.

CPC ..... *B65H 45/12* (2013.01); *B41F 13/56* (2013.01); *B65H 45/04* (2013.01); *B31B 1/52* (2013.01); *B65H 45/18* (2013.01); *B65H 2406/12* (2013.01)

(58) Field of Classification Search

CPC ..... B31B 1/52; B65H 45/04; B65H 45/12; B65H 45/18

USPC ..... 270/32; 493/22, 23, 35, 36, 434, 435, 493/437, 454

See application file for complete search history.

(56) References Cited

U.S. PATENT DOCUMENTS 3,419,261 A 12/1968 Sjostrom
3,578,311 A 5/1971 Wood et al.
(Continued)

FOREIGN PATENT DOCUMENTS

CN 102815574 A 12/2012
DE 3544495 A1 6/1987
(Continued)

OTHER PUBLICATIONS

Search Report issued in European Application 13190199 dated Feb. 10, 2014.
European Search Report of CH 21792012 dated Feb. 15, 2013.

*Primary Examiner* — Leslie A Nicholson, III
(74) *Attorney, Agent, or Firm* — FisherBroyles, LLP; Robert Kinberg

(57) ABSTRACT

An apparatus for folding print sheets includes two folding rollers arranged on one side of a guide plane to define a folding gap. A compressed air device is arranged on the other side of the guide plane in a region of the folding gap. The compressed air device is connected to the compressed air source and to the control unit, and includes an exit opening for the compressed air that is focused onto the folding gap. Control elements can be activated by the control unit to change the time interval during which the at least one exit opening is admitted with compressed air, and/or the cross-sectional surface of the exit opening, and the pressure of the compressed air supplied to the exit opening may also be changed by a different control element, to adapt a compressed air blast to properties of the print sheet made available to the folding gap.

20 Claims, 6 Drawing Sheets

(56) References Cited

U.S. PATENT DOCUMENTS

| | | | |
|---|---|---|---|
| 4,053,150 | A | 10/1977 | Lane |
| 4,624,095 | A | 11/1986 | Gietman, Jr. |
| 5,518,574 | A | 5/1996 | Yates et al. |
| 6,309,336 | B1 | 10/2001 | Muessig et al. |
| 2002/0140793 | A1 | 10/2002 | Summers |

FOREIGN PATENT DOCUMENTS

| | | | |
|---|---|---|---|
| DE | 10238502 | A1 | 2/2004 |
| GB | 190912124 | A | 3/1910 |

SYSTEM AND METHOD FOR FOLDING PRINTED SHEETS

CROSS-REFERENCE TO RELATED APPLICATION

This application claims the priority of Swiss Patent Application No: 02179/12, filed on Oct. 30, 2012, the subject matter of which is incorporated herein by reference.

BACKGROUND OF THE INVENTION

The invention relates to an apparatus and a method for folding print sheets or signatures.

For the further processing of printed-on sheets of paper, so-called print sheets which comprise two or more printed pages, these print sheets are bent over at least once under the effect of pressure to form a sharp edge, meaning they are folded to the format of the finished printed product along a previously perforated or grooved folding line, or also along a non-prepared folding line, according to a predetermined folding pattern. With reference to the feeding direction for the print sheets, cross-folding as well as longitudinal folding devices are used for this, wherein a single device, multiple devices or also a combination thereof can be arranged in a folding machine. The folding can be realized with the aid of a so-called pocket folding and/or sword folding principle. Regardless of the type of apparatus used and the respective method, the precision of each individual fold is decisive for the quality of the printed product to be produced.

German patent document DE 3544495 A1 discloses a folding apparatus for the cross-folding which operates based on the sword-folding principle. With this apparatus, respectively one print sheet is supplied with the aid of feed rollers in a feeding direction to a folding table and against an end stop arranged thereon. The folding table contains an opening, embodied transverse to the feeding direction, above which a mechanically operated folding sword is arranged. Two folding rollers are arranged below the folding table, in the region of and parallel to this opening. As soon as the front edge of the print sheet to be folded impacts with an end stop that projects upward from the folding table, as seen in the feeding direction, this triggers the lowering of the folding sword onto the print sheet positioned on the folding table. The folding sword presses against the folding line, meaning against an imaginary straight line on the print sheet along which the sheet is to be folded, and thus moves the print sheet through the opening of the folding table and toward the folding rollers. The print sheet is then gripped by the folding rollers and pulled into the folding gap, formed in-between the rollers and, in the process, is folded and also compressed along the folding line. The print sheet folded in this way is subsequently conveyed away in an downward direction with the aid of the folding rollers. Furthermore known are folding machines having a folding sword arranged below the folding table and having folding rollers arranged above the folding table. With these machines, the folded print sheet is respectively conveyed away in upward direction.

Regardless of its specific arrangement, a mechanical sword of this type requires very precise and involved geometric adjustments. Adapting the length of the folding sword to the format of the print sheets can furthermore be realized only with great expenditure. In addition, a mechanical folding sword requires a relatively large structural area, but is nevertheless hard to access. Owing to the required high folding capacity, the folding sword must move at the highest possible speed and therefore impacts at relatively high speed with the print sheet. To avoid contact with the folding rollers and to clear the space on the folding table as quickly as possible for supplying the following print sheet, the folding sword must reverse its movement direction just prior to reaching the folding rollers, so as to move in the direction opposite to the previous lowering movement. The print sheet to be folded is therefore in an undefined movement shortly before takeover through the folding rollers. The print sheet can thus deviate from the specified movement path and may not be gripped by the folding rollers, thereby resulting in the continuous danger of jamming of the successively supplied print sheets. In addition, print sheets arriving while offset, relative to the folding position, can only be folded with high technical expenditure along the predetermined folding line. Finally, the forming of so-called dog ears, meaning the folding over of the ends of the print sheets at high speeds, can hardly be controlled because corresponding guide elements are only conditionally usable owing to the space required for the mechanical sword. Accordingly, the danger of reducing the quality of the later printed product can be reduced with high technical expenditure, but cannot be eliminated.

When using an also known rotating folding sword, which is suitable for high folding capacities, the folding point in time can hardly be varied because of the mass inertia of the apparatus.

German patent document DE 10238502 A1 discloses a suitable method and apparatus for the cross-folding or the longitudinal folding of respectively one print sheet, wherein a pneumatic sword is used instead of a mechanical one, meaning a compressed air device consisting of a tube with preferably downward directed exit openings. The print sheet is supplied to this apparatus while positioned in a guide plane and is thus made available in a folding position where the predetermined folding line is located below the exit openings of the compressed air device. At that location, a control unit transmits a trigger pulse to the compressed air device for issuing a strong blast of compressed air, e.g. measuring several hundred bars, which blast is directed toward the folding line of the print sheet. As a result of the effect of this compressed-air blast, the print sheet is guided along its folding line into the folding gap between the folding rollers. Since a non-defined movement path of the print sheet is precluded in this way, the danger of a lower quality of the final printed product can thus be reduced as compared to using a mechanical sword.

Owing to the arrangement and the design of the compressed air device and the strong compressed air flow generated therewith, however, this solution does not permit an adaptation to changed properties for print sheets to be folded successively. These changed properties for the print sheets can include, for example, the format, the number of printed pages on each print sheet, as well as the grammage [grams per square meter] of the material used for the respective print sheet. For example, the strong blast of compressed air directed toward relatively lightweight print sheets, meaning print sheets with a small format and/or made of thin paper, could scrunch up these sheets before blowing them into the folding rollers. On the other hand, with relatively heavy print sheets, the blast of compressed air may not be sufficient to transport these sheets quickly enough to the folding rollers.

When creating a cross fold immediately prior to creating a longitudinal fold, the cross folding operation will create a gap between the folded print sheets, with the mechanical as well as with the pneumatic sword, wherein this gap corresponds to the length of the respective print sheet. When using a variable format, meaning sheets having a variable length which are to be folded successively, the relatively stable folding edge of the cross fold cannot be moved to a fixed position that is defined as advantageous for transferring the print sheet to the following machine because the folding edge of a following, shorter print sheet is otherwise already located in the sword folding region, thus making it impossible to fold the preceding print sheet. As a result, an involved and adjustable end stop is necessary. In addition, the lowered mechanical sword as well as the compressed air flow of the pneumatic sword, which is directed onto the print sheet to be folded, prevents an immediate feeding of the following print sheet and thus a quicker production.

Especially when processing further sheets that are printed sequentially with the aid of digital printers, which can print the sheets in the predetermined sequence for the finished printed product, thus making it possible to produce the product in relatively small piece numbers up to a single copy, successively following print sheets frequently have different properties in contrast to the traditional printing methods, such as the offset printing. The different properties can involve the format, the number of pages printed on each print sheet, the grammage and the porosity of the material used, the frictional values of the material surface, the residual moisture with or without upstream connected dryer and/or humidifier, the weight distribution and the frictional value distribution for the print sheet, relative to its folding line, the color assignment values, the electrostatic charge, as well as the temperature and moisture values of the material. Of course, the properties of the print sheets to be further processed are also influenced by changing processing and/or environmental conditions, such as the respectively used printing methods, the use of upstream-connected dryers and/or humidifiers, or the temperature and humidity in the production room. The properties of the print sheets as well as the processing and environmental conditions can either be detected during the further processing operation or can be taken from a database made available by a super-imposed system.

Finally, digital printers which transfer the print image directly from a computer to the printer and without the use of static print forms, are nowadays used to imprint higher and higher numbers of print material per time unit, which poses clearly higher requirements for the quality as well as the capacity of the devices used for the processing, for example the folding devices.

SUMMARY OF THE INVENTION

It is therefore an object of the invention to create an apparatus and a method for the folding of print sheets which would allow a simple and cost-effective adaptation to the changing properties of successively arriving print sheets, with simultaneously high folding quality and capacity, wherein this would make the apparatus and method suitable for use in the further processing of sheets printed sequentially with the aid of digital printers.

In an embodiment of the invention, there is provided an apparatus for folding print sheets, comprising: at least one first guide element defining a guide plane in which the print sheet is made available in a folding position; at least two folding rollers, arranged on a first side of the guide plane and respectively provided with one rotational axis wherein a folding gap is defined between the at least two folding rollers for the print sheet to be folded, wherein the rotational axes are oriented parallel to each other and essentially parallel to the guide plane; a compressed air source; a control unit; a compressed air device, arranged essentially parallel to the rotational axes of the folding rollers on a second side of the guide plane which is essentially arranged opposite the first side of the guide plane, in a region of the folding gap, wherein the compressed air device is connected to the compressed air source and to the control unit, and includes at least one exit opening for the compressed air that is focused onto the folding gap; and control elements connected to the compressed air source and to the control unit, wherein the control elements are activateable by the control unit, so that (1) the time interval during which the at least one exit opening is admitted with the compressed air, (2) the cross-sectional surface of the at least one exit opening, and (3) the pressure of the compressed air supplied to the at least one exit opening are changeable to adapt to properties of the available print sheet.

According to another embodiment, there is provided a method for folding print sheets, comprising: making available a print sheet to a folding position located in a guide plane adjacent a folding gap between two rotating folding rollers located on one side of the guide plane and having respectively one rotational axis, wherein the rotational axes are oriented parallel to each other and parallel to the guide plane; admitting the print sheet in the region of the folding gap with a compressed air blast from a second side of the guide plane that is located opposite the first side, the compressed air blast coming from a compressed air device connected with a compressed air source and a control unit, the compressed air device having at least one exit opening with a cross-sectional surface for the compressed air that is focused onto the folding gap, the admitting including changing, with aid of the control unit, at least one of (a) a time interval during which the at least one exit opening of the compressed air device is admitted with compressed air, (b) the cross-sectional surface of the at least one exit opening and (c) the pressure of the compressed air supplied to the exit opening, to adapt to the properties of the available print sheet, wherein the print sheet is transported under the effect of the compressed air blast out of the guide plane and to the rotating folding rollers; and folding the print sheet on the first side of the guide plane between the at least the two rotating folding rollers.

The apparatus according to the invention is provided with control elements that are connected to the compressed-air source and to the control unit, so as to allow changing a time interval during which the at least one exit opening of the compressed-air unit is supplied with compressed air, and/or for changing a cross-sectional surface of this exit opening, and/or for changing the pressure of the compressed air that can be supplied to this exit opening. The control elements can thus be triggered via the control unit so that the time interval during which compressed air is supplied to the at least one exit opening, and/or the cross-sectional surface of this exit opening, and/or the pressure of the compressed air supplied to this exit opening can be changed, so as to adapt the compressed air blast to the properties of the available print sheet. With the method according to the invention, the time interval during which compressed air is supplied to the at least one exit opening, and/or the cross-sectional surface of this exit opening is changed, and/or the pressure of the compressed air supplied to this exit opening is changed, to thereby adapt the compressed air blast via the control unit to the properties of the available print sheet.

By correspondingly triggering at least one of the control elements, it is possible to emit easily and quickly a metered blast of compressed air from the compressed air device, to achieve a good folding quality as well as a high folding capacity that covers the complete spectrum of print sheets to be folded, corresponding to the aforementioned properties such as grammage, format, frictional value, porosity, color assignment etc. for a print sheet that is provided in the folding position.

According to one embodiment of the inventive apparatus, the compressed air device has at least two first exit openings with identically large cross-sectional surfaces and at least two second exit openings with identically large cross-sectional surfaces, wherein the cross-sectional surfaces of the first exit openings preferably differ in size from those the cross-sectional surfaces of the second exit openings. The apparatus furthermore comprises at least one control element and at least one other control element for changing the time interval during which the exit openings are admitted with compressed air and for changing the cross-sectional surfaces of the exit opening, wherein the first exit openings are connected to the one control element and the second exit openings are connected to the other control element. In addition to these control elements, the apparatus is also provided with at least one additional control element, connected to the exit openings, for changing the pressure of the compressed air that is supplied to the exit openings.

The respective time intervals for admitting the first and the second exit openings with compressed air and for changing the cross-sectional surfaces of these exit openings are changed by admitting the first exit openings with the aid of the one control element and the second exit openings with the aid of the other control element, so as to match the properties of the available print sheet to be folded. In addition, a pressure of the compressed air that is supplied to the exit openings can optionally be changed with the aid of the at least one additional control element that is connected to the exit openings.

With this apparatus and/or with the corresponding method, the cross-sectional surfaces of the exit openings in the compressed air device, as well as the time intervals for admitting these exit openings with compressed air, can be changed particularly easily, quickly and precisely, thereby making it possible to further improve the folding quality as well as the folding capacity in a cost-effective manner.

For different embodiments of the apparatus, a first or a second feeding direction exists for making available the print sheet, wherein these feeding directions extend essentially parallel or at a right angle to the rotational axes of the folding rollers. The print sheets can thus be made available while positioned essentially parallel to or essentially at a right angle to the rotational axes of the folding rollers and can accordingly be folded in cross direction or in longitudinal direction.

According to a different embodiment of the apparatus, the compressed air device consists of at least two segments, arranged side-by-side in the first feeding direction or arranged one behind the other in the second feeding direction, which respectively comprise at least one exit opening with a cross-sectional surface. Each segment is connected to the compressed air source as well as to the control unit, is provided with at least one control element, and is embodied such that it can be triggered separately with the aid of compressed air. The segments respectively comprise at least a first control element for changing the time interval during which the at least one exit opening is admitted with compressed air, and/or at least one second control element for changing the cross-sectional surface of this exit opening, and/or at least one third control element for changing a pressure of the compressed air that can be supplied to this exit opening. During the operation of the apparatus, each segment is activated separately with compressed air and the control unit triggers a modified compressed air blast, corresponding to the properties of the available print sheet, which is blown onto the available print sheet from the at least one exit opening of at least one of the segments of the compressed air device.

As a result of the segmenting of the compressed air device, at least two regions of the apparatus, arranged side-by-side or one behind the other in the feeding direction, can advantageously be admitted with compressed air, so that at least two successively supplied print sheets can advantageously be treated in the apparatus, either in the same way or also differently, corresponding to their properties. By correspondingly triggering at least one of the control elements of at least one segment, the metered blast of compressed air blast from the at least one segment, from several segments, or from the compressed air device as a whole can be metered out easily and quickly to achieve a good folding quality and a high folding capacity over the complete spectrum of print sheets to be folded, corresponding to the properties of the available print sheet.

According to a different embodiment of the inventive apparatus, at least one first guide element for the print sheet is arranged essentially in the guide plane. Furthermore provided is at least one second guide element for the print sheet, which is arranged between the at least one first guide element and the compressed air device and extends straight into the region of the exit openings for the compressed air device, thus ensuring a defined guidance of the two trailing ends of a print sheet conveyed into the gap between the folding rollers.

According to a different embodiment of the inventive apparatus, at least a first and a second folding position, arranged one behind the other and spaced apart in the guide plane, are formed in the second feeding direction. Arranged downstream of the folding rollers are at least two removal sections for the print sheets. The first removal section in this case is embodied to accommodate at least one print sheet, provided in the first folding position, while the second removal section is embodied to accommodate at least a print sheet provided in the second folding position. The print sheet according to a different embodiment of the inventive method is accordingly made available in one of at least two folding positions, arranged successively in the second feeding direction. The respective folding position is selected based on a specified production order, and the blast of compressed air is blown only onto the print sheet that is available in the folding position. Following the folding operation, the print sheet is then accommodated in one of at least two removal sections.

Finally, according to yet another embodiment of the inventive method, at least two successively following print sheets are provided respectively in the other of the two folding positions that are provided and, following the folding operation, are accommodated in respectively the other of at least two removal sections.

Owing to the embodiment of the apparatus with at least two folding positions and at least two removal sections that operate jointly with the folding positions and as a result of admitting each separate section with compressed air from the compressed air device, a following print sheet can advantageously be transported into the apparatus before a preceding print sheet has reached its folding position, thereby noticeably increasing the capacity of the inventive method. With this solution, the print sheets can furthermore be divided particularly easily into at least two product flows, thus making it possible to omit a corresponding deflector function of an upstream-arranged or a downstream-arranged unit. Also possible, for example, is the removal of print sheets that do not meet quality requirements with the aid of the second folding position and therewith cooperating removal section while parallel thereto, the production can continue via the first folding position and therewith cooperating removal section.

According to yet another embodiment of the inventive apparatus, at least a first and a second folding position, arranged overlapping, are embodied successively in the guide plane, in the second feeding direction. A joint removal section is arranged downstream of the folding rollers, which is embodied such that it can accommodate at least one print sheet provided in the first folding position and at least one print sheet provided in the second folding position, wherein these are positioned overlapping in the second feeding direction. During the operation of said apparatus, at least two successively following print sheets are made available overlapping in respectively the other of at least two folding positions, arranged one behind the other in the second feeding direction. For this, the respective folding position is selected based on a specified production order. The compressed air blast in each case is directed only toward the print sheet located in the folding position. Following the folding operation, the print sheets are accommodated, so as to overlap, in a joint removal section. At least two overlapping product flows, formed with folded print sheets, can thus advantageously be conveyed jointly and can be processed further either jointly or separately.

A different embodiment of the inventive apparatus comprises at least one first and at least one second end stop, respectively arranged in the guide plane, wherein the second end stop is arranged in the second feeding direction, upstream of the first end stop. Both end stops are embodied so as to be lifted up above the guide plane and/or lowered below the guide plane. These optional end stops function to support the print sheets located in the respective folding position.

According to yet another embodiment of the inventive apparatus, the compressed air device has an orientation plane that extends parallel and at a distance to the guide plane, wherein the compressed air device is arranged displaceable in this orientation plane and/or is arranged pivoting therein. The compressed air device can thus be displaced parallel to the guide plane and/or can be pivoted, and a print sheet that is supplied while twisted and/or otherwise positioned incorrectly can nevertheless be conveyed with the optimum orientation to the folding rollers by admitting it with a compressed air blast coming from correspondingly oriented exit openings.

A different embodiment of the inventive method provides that at least one second blast of compressed air is directed toward the same print sheet, following the first blast of compressed air, wherein the pressure and/or the time interval for the second blast of air is advantageously selected to be different from the first compressed air blast. As a result, the folding quality of the print sheet can be improved further. In particular with print sheets having an asymmetric geometry, meaning print sheets not having the same number of pages, it is possible to avoid dog eared areas at the trailing ends of the folded print sheets when using at least one additional compressed air blast of this type.

According to yet another embodiment of the inventive method, the compressed air blast directed onto the available print sheet is suppressed and the print sheet is removed from the guide plane. Print sheets which do not meet quality requirements can thus be advantageously removed without the use of an additional device, meaning this operation can be realized easily and cost-effectively.

BRIEF DESCRIPTION OF THE DRAWINGS

These and other features and advantages of the invention will be further understood from the following detailed description of embodiments with reference to the drawings, which show in.

DETAILED DESCRIPTION

Figure 1:
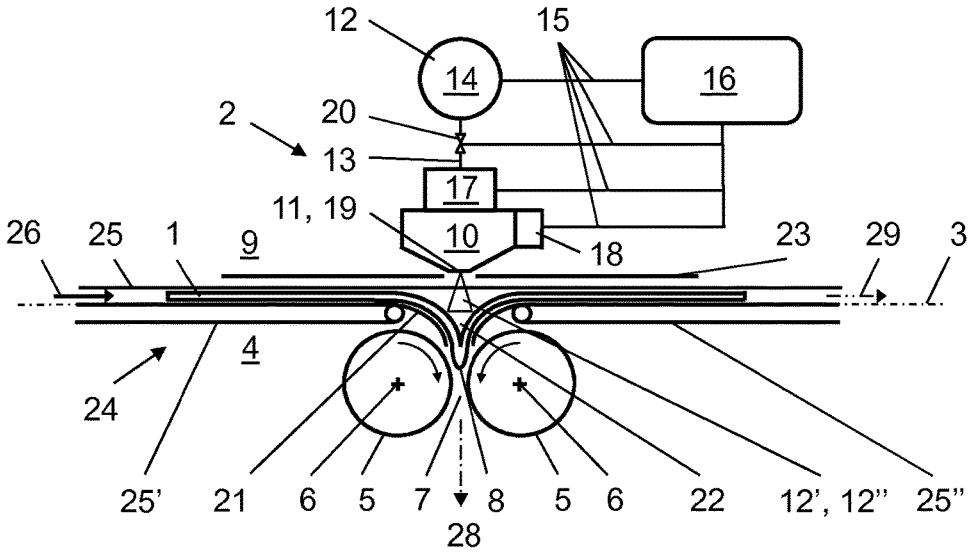
FIG. 1 A schematic view from the front of a first embodiment of the inventive apparatus for print sheets to be folded crosswise to the feeding direction.

According to the first exemplary embodiment shown in FIG. 1, an apparatus 2 according to the invention, which is designed for the cross folding of a print sheet 1 comprising respectively at least two printed pages, is provided with a guide plane 3 in which the individual print sheets 1 to be folded are supplied and from which the print sheets 1 can be conveyed further to the folding position. The guide plane 3 is shown extending horizontally herein, but can also extend in vertical direction or be arranged at any optional angle in space which makes possible a plurality of design options, depending on the specific conditions for use. Even though only a single print sheet 1 is described here and also in the following text, and for reasons of simplicity only a single print sheet 1 is shown, at least one print sheet 1 is referred to each time, meaning it can relate to a single sheet 1 or several sheets stacked one above the other.

Two folding rollers 5 are arranged on a first side 4 of the guide plane 3 which, for drawing reasons, are shown in the first embodiment below the guide plane 3. The individual rollers are provided with a separate rotational axis 6 and form a folding gap 7 between them for the folding of the print sheet 1 along a predetermined or also not predetermined folding line 8. The rotational axes 6 of the folding rollers 5 are oriented parallel to each other as well as parallel to the guide plane 3. On a second side 9 which is shown above the guide plane 3 for the example in FIG. 1 and is located opposite the first side 4 of the guide plane 3, a compressed air device 10 is arranged in the region of the folding gap 7. The compressed air device 10 is provided with at least one and preferably several exit openings 11 for the compressed air 12 which are directed toward the folding gap 7. The compressed air device is connected via a compressed air line 13 to a compressed air source 14 which, in turn, is connected via a control line 15 to a control unit 16 of the apparatus 2. The compressed air device 10 furthermore comprises a first control element 17, e.g. embodied as a magnetic valve, for changing the time interval during which the at least one exit opening 11 is admitted with compressed air 12. The compressed air device furthermore comprises a second control element 18, e.g. embodied herein as a slider, for changing a cross-sectional surface 19 of the exit opening 11, as well as a third control element 20 that is arranged in the compressed air line 13 and is embodied, for example, as a pressure-reducing valve for changing the pressure of the compressed air 12 which is supplied to this exit opening 11. The control elements 17, 18 and 20 are connected via separate control lines 15 to the control unit 16.

Essentially arranged in the guide plane 3 of the apparatus 2 is a first guide element 21 for the print sheet 1, on which the available print sheet rests and which is provided with an opening 22 in the region of the folding gap 7 for the print sheet 1 as well as for the compressed air 12 blown out of the exit openings 11, respectively in the form of a blast of compressed air 12'. In addition to the first guide element 21, a second guide element 23 is provided for the print sheet 1, which is arranged between the first guide element 21 and the compressed air device 10, and can operate jointly with the first guide element 21, if necessary.

A guide table can be used, for example, as the first guide element 21. Of course, several small, spaced-apart guide elements can also be arranged side-by-side and/or one behind the other, instead of a single guide table. As shown in FIG. 1, the first guide element 21 can be extended in the region of its opening 22 from the guide plane 3 to near the region of the folding rollers 5, so as to ensure a better guidance of the print sheet 1 toward the folding rollers 5. A stationary element can also be used for the second guide element 23, such as a sheet-metal guide. The second guide element 23 extends up to the immediate region of the exit openings 11 on the compressed air device 10, so that the two trailing ends of the print sheet 1 which is conveyed into the folding gap 7 between the folding rollers 5 can advantageously also be subjected to a defined guidance by the second guide element 23. Of course, the second guide element 23 can also consist of several small individual elements which are arranged spaced-apart, either side-by-side and/or one behind the other. In the same way as the guide plane 3 of the apparatus 2, the first and the second guide elements 21, 23 can also be arranged horizontally, vertically or at any optional angle in space, depending on the concrete use requirements.

The apparatus 2 finally comprises a transport unit 24, consisting of an upper transport belt 25 and two circulating lower transport belts 25', 25" which are intended to make available the print sheets 1 in a first feeding direction 26 that extends substantially at a right angle to the rotational axes 6 of the folding rollers 5. The apparatus 2 can thus be used for the cross-folding of print sheets 1.

Figure 2:
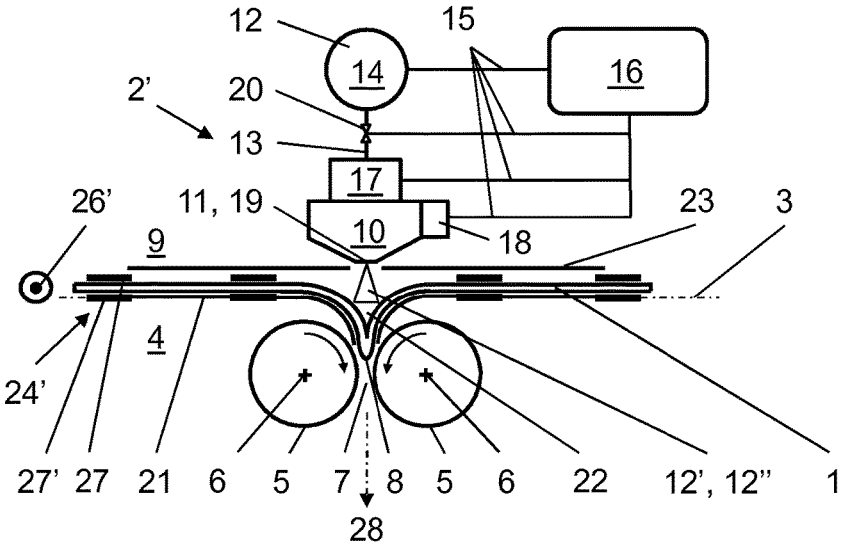
FIG. 2 A schematic frontal view of a second exemplary embodiment of the inventive apparatus, for print sheets to be folded in longitudinal direction.

Corresponding to a second exemplary embodiment, illustrated in FIG. 2, an inventive apparatus 2', designed for the longitudinal folding of print sheets 1 that contain respectively two printed pages, is provided with a second feeding device 26' for the print sheet 1 which extends parallel to the rotational axes 6 of the folding rollers 5 and, accordingly, also comprises a second transporting unit 24' that extends parallel to the rotational axes 6 of the folding rollers 5 and is provided with upper and lower transport belts 27, 27'. The remaining components of the apparatus 2' correspond for the most part to those of the apparatus 2 described for the first exemplary embodiment.

During the operation of the apparatuses 2, 2', shown in FIGS. 1 and 2, the control unit 16 transmits a triggering pulse to the compressed air device 10 for emitting a blast of compressed air 12' that is directed via the at least one exit opening 11 onto the folding line 8 of the respective print sheet 1. With the aid of the control unit 16, the time interval during which the at least one exit opening 11 of the compressed air device 10 is admitted with compressed air 12 is changed, and/or a cross-sectional surface 19 of this exit opening 11 is changed, and/or the pressure of the compressed air 12 supplied to this exit opening 11 is changed, so as to adapt to the properties of the supplied print sheet 1. The properties of the supplied print sheets 1 are known ahead of time to the control unit 16 which activates the first control element 17 and/or the second control element 18 and/or the third control element 20 if a change occurs in the properties of the print sheet 1 to be folded. In the process, the time interval during which the at least one exit opening 11 of the compressed air device 10 is admitted with compressed air 12 is changed by activating the first control element 17. The cross-sectional surface 19 of this exit opening 11 is changed by activating the second control element 18. The pressure of the compressed air 12 supplied to this exit opening 11 is changed through activating the third control element 20.

The compressed air blast 12' can thus be triggered corresponding to the feeding speed of a print sheet 1, which is respectively known to the control unit 16, wherein the time until the compressed air 12 hits the folding line 8 of the print sheet 1 must be factored in. Of course, the compressed air blast 12' can also be triggered based on an actual position of the print sheet 1, e.g. detected with a sensor that is not shown. The instant of triggering the compressed air blast 12' can furthermore also be varied. Successive print sheets 1 can thus be made available in different folding positions, so that the folded print sheets 1 overlap in the first or the second feeding direction 26, 26' and, if necessary, can be separated again at the overlapping locations for the further processing.

Under the effect of the administered compressed air blast 12', the print sheet 1 is guided along its folding line 8 into the folding gap 7 between the folding rollers 5 where it is folded in cross direction (FIG. 1) or in longitudinal direction (FIG. 2). The folding rollers 5 subsequently transport the folded print sheets 1 to a removal section 28, which is not shown in further detail herein.

A sensor, not shown herein, can be arranged downstream of the folding rollers 5 to detect dog ears, incorrectly folded areas and the like and can transmit corresponding signals to the connected control unit 16. Following an automatic evaluation of this information, the compressed air device 10 and/or the compressed air blast 12' can be activated accordingly, so as to avoid future quality deficiencies of this type. The compressed air device 10 and therefore also the complete apparatus 2, 2' are embodied to be self-teaching.

If a print sheet 1 which does not meet quality requirements is made available in the apparatus 2, 2' and this is detected, for example with a non-depicted sensor, the control unit 16 can then suppress the pulse for triggering a compressed air blast 12', so that this print sheet 1 is transported further to a removal section 29 (FIG. 1), not shown in further detail herein, with the aid of the respective transport unit 24, 24' in the guide plane 3 and can be removed from the apparatus 2, 2'. A corresponding diverter function of an upstream or downstream positioned device can thus advantageously be omitted.

Figure 3:
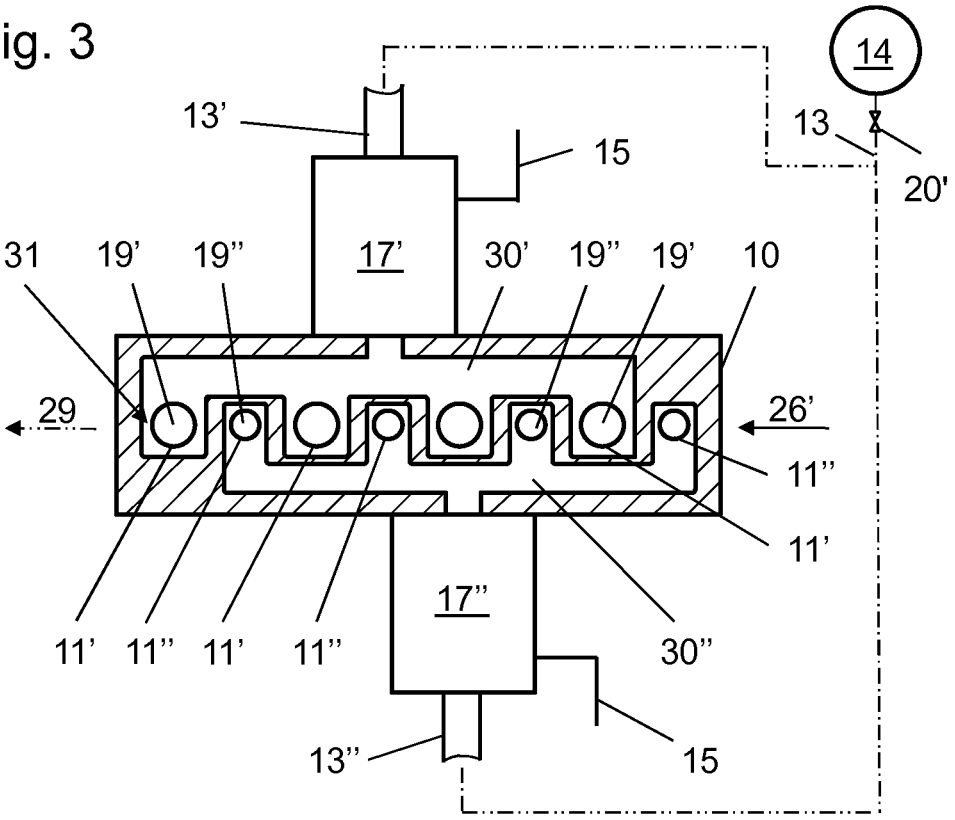
FIG. 3 An enlarged, schematic representation of a section through an apparatus according to FIG. 2, comprising a compressed air device with several exit openings arranged in a row.

The schematic representation in FIG. 3 depicts a section through the compressed air device 10. In this additional variant to the exemplary embodiments shown in FIGS. 1 and 2, there is provided two compressed air lines 13', 13" that are connected to the compressed air source 14. Control element 17', 17", that are embodied as magnetic valves, respectively function to change the time interval during which the exit openings 11', 11" of the compressed air device 10 are admitted with compressed air 12, and to change the cross-sectional surfaces 19', 19" of the exit openings 11', 11". The compressed air device 10 is furthermore provided with a separate distribution line 30', 30" for respectively four first and/or second exit openings 11', 11", arranged on the inside of the compressed air device 10 and respectively connected to the compressed air lines 13', 13", wherein the first exit openings 11' are connected to the one control element 17' and the second exit openings 11" are connected to the other control element 17". Of course, it is also possible to have respectively two, three or more than four exit openings connected to the distribution lines 30' and/or 30" instead of the herein illustrated, respectively four exit openings 11', 11". The cross-sectional surfaces 19', 19" of the exit openings 11', 11" belonging to the same distribution line 30', 30" are embodied identically in each case, wherein the size differs from the size of the four exit openings 11", 11' belonging to the respectively other distribution line 30', 30" in such a way that the four first exit openings 11' are embodied with the larger cross-sectional surface 19' and the four second exit openings 11" are embodied with the smaller cross-sectional surface 19".

This variant permits a relatively easy metering of the compressed air blast 12' coming from the compressed air device 10. For example, if the two control elements 17', 17" are opened, this results in high pressure for the compressed air 12 in the compressed air device 10, meaning a relatively strong compressed air blast 12'. However, the compressed air device 10 is inactive if the two control elements 17', 17" are closed. A weak compressed air blast 12' is generated if only the control element 17" is opened, which is connected to the exit openings 11" having respectively a small cross-sectional surface 19". In contrast, a medium strong compressed air blast 12' is generated if only the control element 17' is opened which is respectively provided with exit openings 11' having a larger cross-sectional surface 19'. Through the opening and closing of the two control elements 17', 17", the time interval for admitting the device 10 with compressed air is changed. In addition or alternatively thereto, the pressure at which compressed air 12 is supplied to the exit openings 11', 11" of the compressed air device 10 can be varied by correspondingly triggering an additional control element 20' via the control unit 16, not shown herein, which element is arranged in the compressed air line 13 that leads to the compressed air source 14. The dash-dot lines in FIG. 3 show that the two compressed air lines 13', 13" are joined to form the compressed air line 13 in that case. Of course, all cross-sectional surfaces of the exit openings in the compressed air device 10 can also be embodied to have the same size, in which case only a slight offset in the metered out blast of compressed air 12' can be achieved, as opposed to using differently large cross-sectional surfaces 19', 19".

Figure 7:
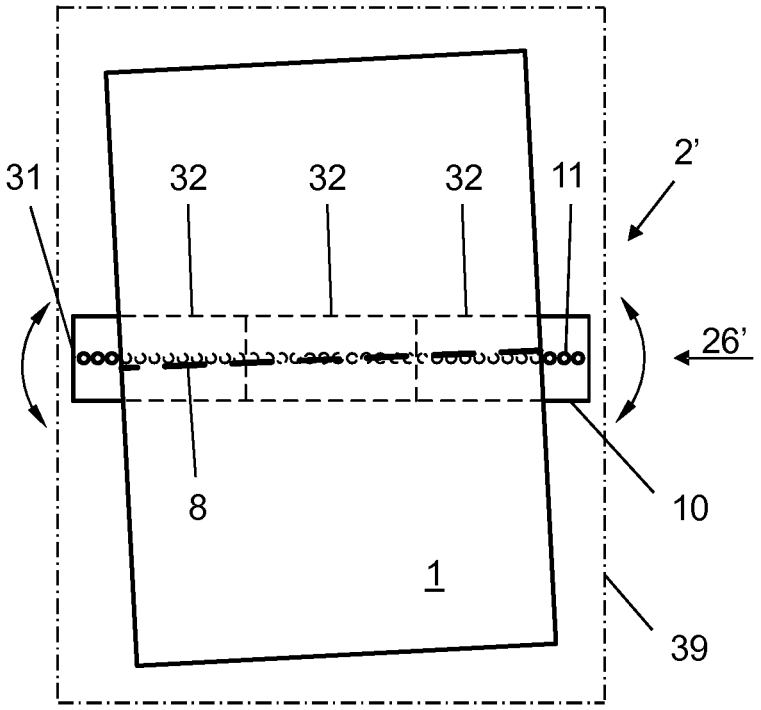
FIG. 7 A view from below of the compressed air device according to FIG. 4, comprising exit openings that are arranged in a single row and a print sheet to be folded, which has been supplied in a twisted position.

As shown in FIGS. 3 and 7, the exit openings 11, 11', 11" of the compressed air device 10 are arranged in a row 31, formed in a plane that is not shown herein and which extends essentially perpendicular through the guide plane 3. As a result, a print sheet 1 that is made available in the correct position to the apparatus 2, 2', in the first or second feeding direction 26, 26', can thus be conveyed with the aid of the generated blast of compressed air 12' precisely and securely to the folding rollers 5 and can be folded therein with high quality.

The compressed air device 10 and the folding rollers 5 each have essentially the same longitudinal extension a, b, wherein the length can, of course, also be different. The compressed air device 10 shown for the additional embodiment of the apparatus 2' in FIG. 4 has a segmented design, comprising three segments 32 which are arranged one behind the other in the second feeding direction 26' for the apparatus 2'. Of course, compressed air devices 10 having only two segments or more than three segments 32 can also be used. Each segment 32 of the compressed air device 10 is embodied such that it can be activated separately with the compressed air 12 and is furthermore provided with one exit opening 11 for the compressed air 12. Of course, more exit openings 11 can also be used for each segment 32, which are arranged in at least one row 31.

Figure 4:
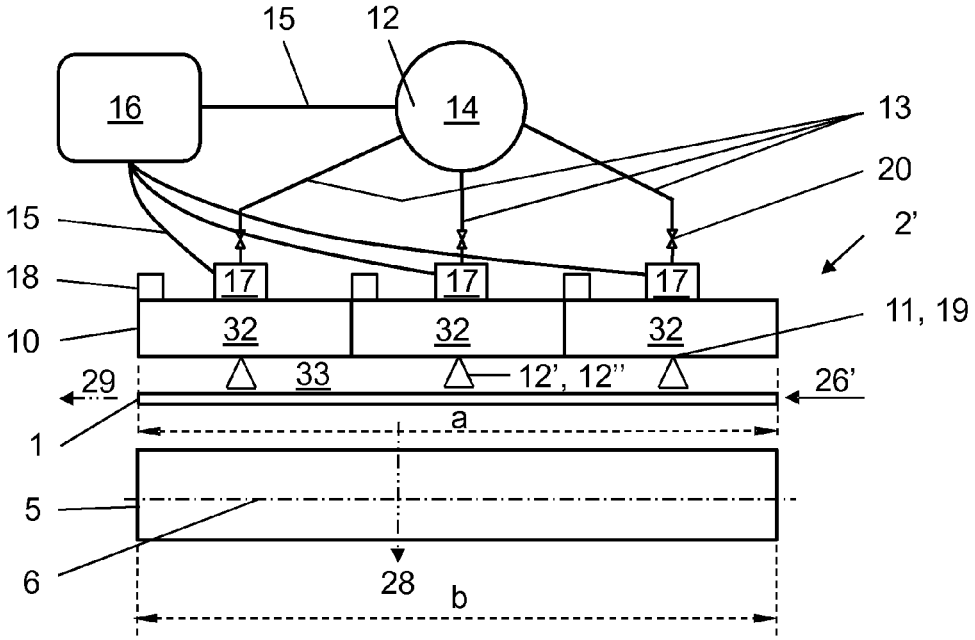
FIG. 4 A schematic view, seen from the side, of portions of the apparatus shown in FIG. 2, but showing a different exemplary embodiment with three segments for the compressed air device and with a folding position for the print sheets.

FIG. 4 illustrates that the segments 32 are each connected to the compressed air source 14 via a separate first control element 17, which is also embodied as a magnetic valve, and a compressed air line 13. In addition, the individual segments 32 are provided with a second control element 18 that is embodied, for example, as a slider and with respectively a third control element 20 that is embodied as pressure-reduction valve. For reasons of clarity, only the control lines 15 are shown which lead from the control unit 16 to the first control elements 17 and to the compressed air source 14 while the control lines 15 leading to the second and to the third control elements 18, 20 were omitted. Of course, a single compressed air line 13 for all segments 32 can also be used instead of a separate compressed air line 13 for each segment 32, or the segments 32 can be combined into groups and several segments 32 can be supplied via a joint compressed air line 13. In that case, correspondingly arranged control elements, not shown herein, ensure that the segments 32 and/or their exit openings 11 are admitted with compressed air 12.

The exit openings 11 of the segments 32 each have a cross-sectional surface 19, wherein the size of the cross-sectional surfaces 19 can be changed, for example through using correspondingly adjustable apertures, not shown herein, which are controlled by the second control element 18. The shape of the cross-sectional surfaces 19 is freely selectable, meaning cross-sectional surfaces 19 can have a circular, semi-circular or elliptical shape, but can also have a rectangular, triangular or gap-type shape. As an alternative to changing the size of the cross-sectional surfaces 19, or also in addition thereto, the pressure of the compressed air 12 supplied to the exit openings 11 can also be varied by correspondingly triggering the third control element 20 with the aid of the control unit 16. Finally, the time interval for admitting the segments 32, and thus also the exit openings 11, with the compressed air 12 can alternatively or additionally also be changed.

To generate a longitudinal fold in a print sheet 1 with the aid of the apparatus 2', shown in FIG. 4, the respective print sheet 1 is supplied in a clocked operation in the second feeding direction 26' while positioned in the center and parallel to the rotational axes 6 of the folding roller 5, thus also parallel to the compressed air device 10, and is made available in a folding position 33 for the folding operation. Via the control lines 15 that are connected to the first control element 17, the control unit 16 accordingly triggers a blast of compressed air 12' which is emitted through the exit openings 11 of the segments 32 of the compressed air device 10, as soon as the respective print sheet 1 has reached the folding position 33. In dependence on the properties of the print sheet 1 which are known to the control unit 16, such as the format, the grammage, and the speed, the control unit 16 determines the required pressure that must be generated for the compressed air blast 12' and, correspondingly, adjusts or re-adjusts, if applicable, this compressed air blast with aid of the third control element 20. In addition or alternatively thereto, the cross-sectional surfaces 19 of the exit openings 11 can also be adjusted via the control unit 16 and the second control element 18, and/or the time interval for admitting the individual segments 32 and thus the duration of the compressed air blast 12' can be adjusted via the first control elements 17. The average duration of a compressed air blast 12' is approximately 5 to 10 milliseconds (ms) while the pressure used is in the range of approximately 300 to 800 kPA (3 to 8 bar). Owing to the power exerted by the compressed air blast 12', the print sheet 1 which for the most part is multi-layered is transported out of the guide plane 3 to the rotating folding rollers 5, meaning it is pressed nearly planar against the folding rollers 5. In the process, the print sheet 1 is pulled first in the region of the folding line 8, leading because of the impact of the compressed air 12, and finally completely between the folding rollers 5, meaning into the folding gap 7, is then pressed along the folding line 8 and is subsequently transported further in the downward direction to the removal section 28, which is not shown in further detail herein.

Owing to the fact that the cross-sectional surfaces 19 can be changed and because of the additionally or alternatively supplied compressed air, which is supplied with a different pressure and/or time duration to the exit openings 11, the apparatus 2' can be adjusted or re-adjusted relatively easily and quickly to match the properties of the respective print sheet 1, as well as to adapt it to the requirements of a current production order.

Figure 5:
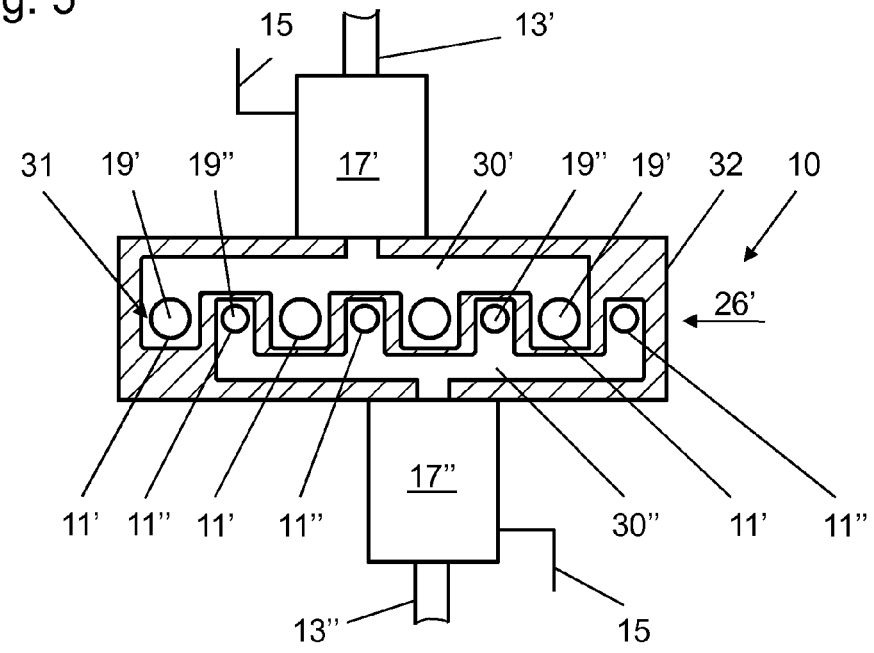
FIG. 5 An enlarged schematic representation of a section through one of the segments of the compressed air device, shown in FIG. 4, revealing several exit openings arranged in a row.

In a schematic representation that is essentially identical to the one shown in FIG. 3, FIG. 5 shows a sectional view through a segment 32, shown in FIG. 4, of the compressed air device 10. The segment 32 of this additional variant comprises two separate compressed air lines 13',13" which are connected to the compressed air source 14, not shown herein, and are provided with control elements 17', 17", that are also embodied as magnetic valves, wherein this segment is designed for changing the time interval during which the exit openings 11', 11" are admitted with compressed air 12, as well as to change the cross-sectional surfaces 19', 19" of the exit openings 11', 11". The segment 32 furthermore comprises for each four first and/or second exit openings 11', 11" respectively one distribution line 30', 30", connected to the compressed air lines 13', 13" and arranged on the inside of the segment 32, wherein the first exit openings 11' are connected to the one control element 17' and the second exit openings 11" are connected to the other control element 17". Of course, it is also possible to have two, three or more exit openings which are connected to the distribution line 30' and/or the distribution line 30" in place of the four exit openings 11', 11". The cross-sectional surfaces 19', 19" of the exit openings 11', 11" belonging to the same distribution line 30', 30" are embodied identically in size, wherein the size differs from the size of the four exit openings 11", 11' belonging to the respectively other distribution line 30', 30", such that the four first exit openings 11' are each embodied with a larger cross-sectional surface 19' and the four second exit openings 11" are embodied with a smaller cross-sectional surface 19".

This modification permits a relatively simple metering out of the blast of compressed air 12' coming from the segment 32. The pressure of the compressed air 12 in the segment 32 is high, for example, if both control elements 17', 17" are opened, meaning it results in a relatively strong compressed air blast 12'. On the other hand, if the two control elements 17', 17" are closed then the segment 32 is inactive. A weak blast of compressed air 12 results if only the control element 17" is opened which is connected to the exit openings 11" with a small cross-sectional surface 19'. A medium-strong compressed air blast 12' is generated by opening only the control element 17' that is connected to the exit openings 11' which have a larger cross-sectional surface 19'. By opening or closing the two control elements 17', 17", the time interval during which the segment 32 is admitted with compressed air 12 is additionally changed. The compressed air 12 can furthermore be supplied with different pressures to the exit openings 11', 11" of the segment 32 by correspondingly triggering an additional control element 20', not shown herein, via the control element 16, also not shown herein. This control element is arranged, for example, in the compressed air line 13 leading to the compressed air source 14 and is embodied as a pressure-relief valve.

During the operation of the apparatus 2', several exit openings 11', 11" in a segment 32 which are respectively connected to the same control element 17', 17" are thus activated simultaneously with compressed air 12. By correspondingly admitting the control elements 17', 17" 20', the blast of compressed air 12' from a single segment 32, from several segments, or from all segments 32 can thus be metered out easily and quickly, in accordance with the properties of the print sheet 1 that is made available in the folding position 33.

Of course, the cross-sectional surfaces 19', 19" of the first and the second exit openings 11', 11" in the segment 32 of the compressed air device 10 can also be embodied identically. However, this results in only a slight gradation of the metered out compressed air blast 12', as compared to the use of the previously described, differently large cross-sectional surfaces 19', 19". In the same way, the cross-sectional surfaces 19, 19', 19" of the exit openings 11, 11', 11" in different segments 32 can be embodied with differently large sizes and/or the compressed air 12 to the exit openings 11, 11', 11" of different segments 32 can be supplied with compressed air having different pressures, and/or the time interval during which the different segments 32 are admitted with compressed air 12 can be selected to be different.

Using at least one of these measures, identical or different blasts of compressed air 12' can advantageously be triggered at the segments 32. As a result, the folding process can be adapted optimally to the aforementioned properties of a print sheet 1 ready for folding, such as grammage, format, frictional value, porosity, color assignment and the like, thus making it possible to achieve a constant and good folding quality. By using at least one of these measures, a deviation from the folding position 33 of the print sheet ready for the folding can furthermore be corrected at least in part. During the cross-folding, asymmetrically folded print sheets 1, for example having different page numbers distributed over the print sheet 1, can be admitted with different blasts of compressed air 12', meaning locations with smaller sheet thickness are admitted with compressed air blasts 12' from the at least one exit opening 11" with a smaller cross-sectional surface 19", and/or blasts with a lower pressure, and/or blasts administered over a shorter time interval than locations having a larger sheet thickness.

Figure 6A:
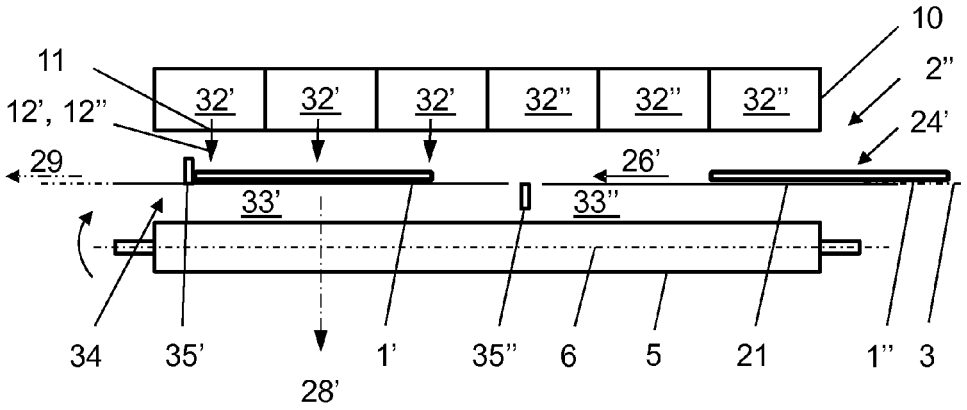
FIG. 6*a* A schematic view from the side, showing portions of a similar apparatus as the one shown in FIG. 4, but showing an additional exemplary embodiment provided with six segments for the compressed air device and two spaced-apart folding positions for the print sheets during a first method step.
Figure 6B:
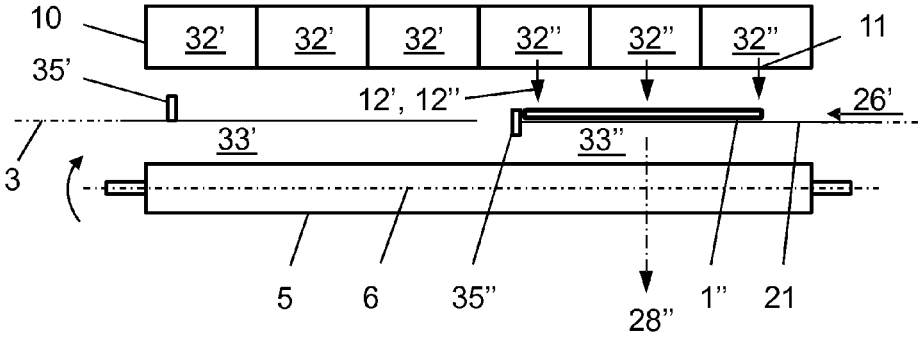
FIG. 6*b* A view corresponding to FIG. 6*a*, but showing a second method step.

The additional exemplary embodiments in FIGS. 6*a* and 6*b* show schematic views from the side of an apparatus 2" for the longitudinal folding of print sheets 1', 1", wherein the control elements previously shown in FIGS. 1 to 5 have been omitted for reasons of clarity. The compressed air device 10 for this apparatus 2" is provided with three downstream arranged segments 32', as well as with three upstream arranged segments 32", and comprises two folding positions 33', 33", arranged successively in feeding direction 26' in which the print sheets 1', 1" are supplied and made available in the second transporting unit 24', only indicated herein, while positioned on the first guide element 21. To support a print sheet 1' that is made available in the first folding position 33', the apparatus 2" is provided with a first end stop 35', arranged in the guide plane 3 at the downstream end 34 of the apparatus 2". To support a print sheet 1" that is made available in the second folding position 33", at least one additional end stop 35" is arranged upstream of the at least one first end stop 35' and is positioned at a distance to the first end stop 35' which exceeds the format. Both end stops 35' and 35" are embodied to be lifted up above the guide plane 3 and/or lowered below the guide plane 3. As compared to the apparatuses 2, 2' shown in FIGS. 1 and 2, the apparatus 2" comprises two removal sections 28', 28" for folded print sheets 1', 1".

In the same way as for the apparatus 2', a first print sheet 1' is supplied for the folding operation in a clocked manner to the apparatus 2" in the second feeding direction 26', positioned in the center and parallel to the rotational axes 6 of the folding rollers 5. However, the sheet in this case is supplied to one of at least two folding positions 33', 33" that are arranged successively in feeding direction 26'. The respective folding position 33', 33" is selected based on a specified production order, and the compressed air blast 12' in each case is directed only onto print sheets 1', 1" that are located in the folding position 33', 33". Accordingly, the control unit 16 triggers a compressed air blast 12' via the first control element 17, emitted through the exit openings 11 of the segments 32' of the compressed air device 10, as soon as the print sheet 1' has reached the desired folding position 33'. With this solution as with the apparatuses 2, 2', a print sheet 1', 1" that does not meet quality requirements can also be transported further with the aid of the transport unit 24' in the guide plane 3 to the removal section 29 and can thus be removed from the apparatus 2". The first end stop 35' is then either lifted up over the guide plane 3 or lowered below this guide plane. With this exemplary embodiment, an upstream-arranged or a downstream-arranged device for providing a diverter function can therefore be omitted.

In FIG. 6*a*, the apparatus 2" is shown during a first method step in which initially the first print sheet 1', supplied in the guide plane 3, has arrived at the first end stop 35' and is available in the first folding position 33'. At that point in time, the following second print sheet 1" has already entered at least partially the apparatus 2". In order to trigger a compressed air blast 12' and thus supply the first print sheet 1' to the folding rollers 5, only the three downstream segments 32' of the compressed air device 10, as seen in feeding direction 26', are admitted with compressed air 12 by correspondingly activating the first control elements 17, while the three upstream arranged segments 32" are deactivated. The folded first print sheet 1' is subsequently transported further with the aid of the folding rollers 5 to the first removal section 28'.

As a result of embodying the apparatus 2 with two folding positions 33', 33" and two removal sections 28', 28", as well as owing to the segment-by-segment admitting with compressed air from the compressed air device 10, the following print sheet 1" can advantageously already be conveyed into the apparatus 2" while the preceding print sheet 1' has not yet reached its folding position 33'.

The following print sheet 1" can then either be conveyed up to the same folding position 33' at the first end stop 35' or, as shown in FIG. 6*b* for the second method step, can be made available in the second folding position 33" which is located further upstream, once the second end stop 35" has been raised up into the guide plane 3 of the apparatus 2". By correspondingly activating only the upstream-arranged segments 32" of the compressed air device 10, this print sheet 1" is subsequently also conveyed to the folding rollers 5, is folded there, and is then transferred to the second removal section 28". By dividing the print sheets 1 into two separate production flows, to be folded separately and conveyed to the separate removal sections 28', 28", the print sheets 1', 1" in the apparatus 2" can already be separated into print sheets 1', 1" belonging together to form a joint book block later on. Based on the current production order, the apparatus 2" can thus be operated with the aid of the control unit 16 in such a way that the print sheets 1', 1" are respectively made available alternately in one of the two folding positions 33', 33" and are thus supplied to the corresponding removal section 28', 28". In addition to the previously described removal of the non-folded print sheets 1', 1", with the aid of the removal section 29, it is also possible to remove folded print sheets 1', 1" that do not meet quality requirements with the aid of one of the removal sections 28', 28" while the production continues with the aid of the other removal section 28", 28'.

With a corresponding design for the second transport unit 24', for example comprising upper and lower transport belts 25, 25', 25", the apparatus 2" can, of course, also be operated without the end stops 35', 35". In that case, the print sheets 1', 1" are supplied exclusively with the aid of the second transport unit 24' and the guide elements 21, 23 to the respective folding position 33', 33". The end stops 35' and 35" can then optionally serve to help make available the print sheets 1', 1".

Figure 6C:
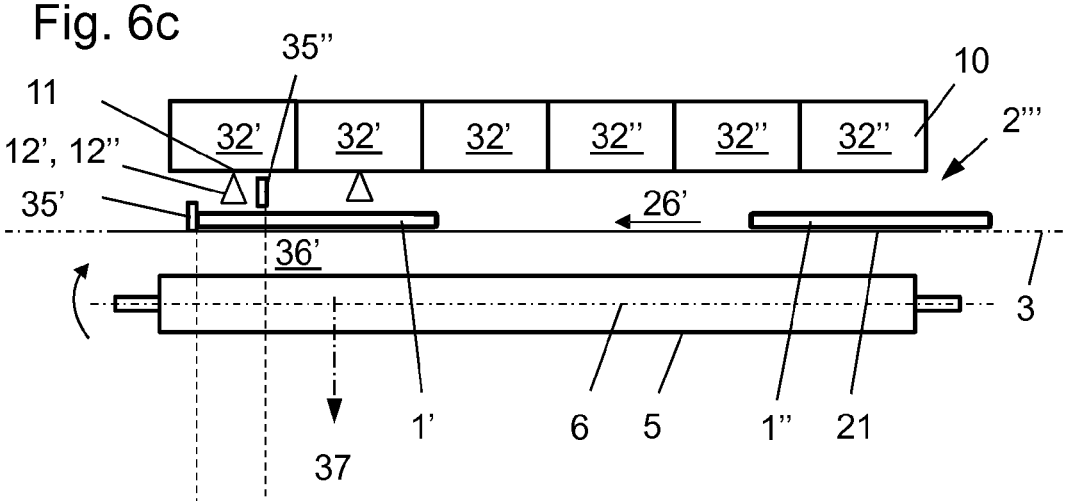
FIG. 6*c* A view corresponding to FIG. 6*a*, but showing a different exemplary embodiment with two overlapping folding positions for the print sheets.
Figure 6D:
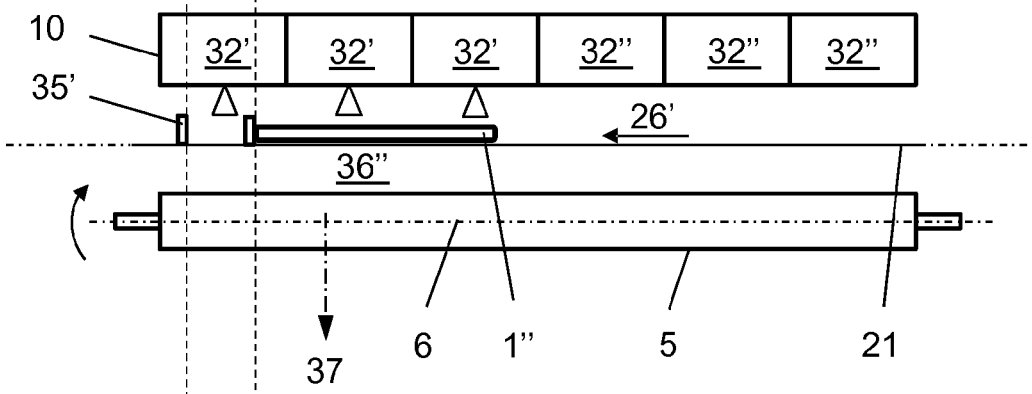
FIG. 6*d* A view corresponding to FIG. 6*c*, but showing a second method step and additionally showing printed products, arranged overlapping, which are conveyed away in a first feeding direction.
Figure 6D:
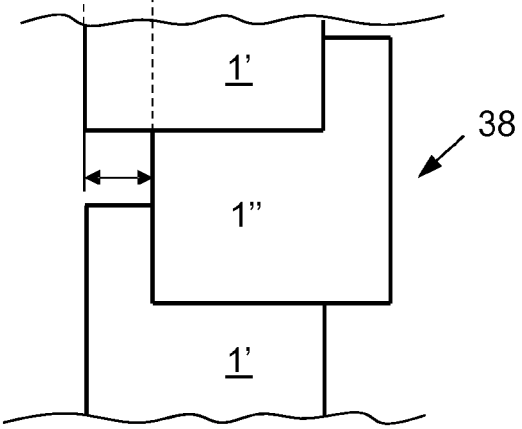

FIGS. 6*c* and 6*d* show another and similar exemplary embodiment, comprising an apparatus 2'", embodied with two overlapping folding positions 36', 36" in the second feeding direction 26' and a joint removal section 37 for the overlapping print sheets 1', 1" instead of the spaced apart folding positions 33', 33" shown in FIGS. 6*a* and 6*b*. The two end stops 35', 35" are thus arranged spaced apart by a measure that is below the format dimensions. Depending on the following further processing, a product flow 38 of folded print sheets 1', 1" which partially overlap in the second feeding direction 26' can thus be generated in the joint removal section 37, wherein these print sheets later on form a joint book block or can also be separated again. Of course, a non-depicted second product flow of print sheets 1', 1" that partially overlap in the second feeding direction 26' can also be generated with this apparatus 2" by repeatedly supplying successively print sheets 1' in the first folding position 36' and/or by repeatedly and successively supplying print sheets 1" in the second folding position 36". With this second product flow, several successively following print sheets 1' and/or several successively following print sheets 1" can furthermore partially overlap crosswise to the second feeding direction 26'.

With the apparatuses 2" and 2'", a compressed air blast 12' can also be triggered prior to reaching the respective folding position 33, 33', 33" in order to reinforce the print sheet 1, 1', 1" through a corresponding deformation transverse to the feeding direction 26' and prevent the danger of deformation in feeding direction 26' which results from the impact of the print sheet 1, 1', 1" with the end stops 35', 35".

With a corresponding design for the second transporting unit 24', for example comprising upper and lower transport belts 25, 25', 25", the apparatus 2'" can also be operated without the end stops 35', 35". In that case, the print sheets 1', 1" are supplied exclusively with the second transport unit 24' and the guide elements 21, 23 and are made available in the respective folding position 36', 36". The end stops 35' and 35" can then be used optionally for helping supply the print sheets 1', 1".

As indicated by the double arrow in FIG. 7, the compressed air device 10 that is also divided into three segments 32 is embodied displaceable with the aid of a motor and/or pivoting, for example, in an orientation plane 39 which extends parallel and at a distance to the guide plane 3, not shown herein, of the apparatus 2'. As a result, a print sheet 1 that is supplied while somewhat displaced or twisted, relative to the apparatus 2', meaning the folding line 8 deviates from the row 31 of exit openings 11, can be admitted precisely with compressed air 12 along the folding line 8 by correspondingly shifting and/or pivoting the compressed air device 10 and can then be conveyed into the folding gap 7 between the folding rollers 5 which are not shown herein. The corresponding offset, meaning the absolute amount by which the print sheet 1 to be folded is displaced or twisted in the guide plane 3 is detected with the aid of non-depicted sensors and the value is then transmitted to the control unit 16. Following this, the control unit 16 activates a servomotor, also not shown herein, which displaces and/or pivots the compressed air device 10 in the orientation plane 39, thereby compensating for the offset of the print sheet 1.

Figure 8:
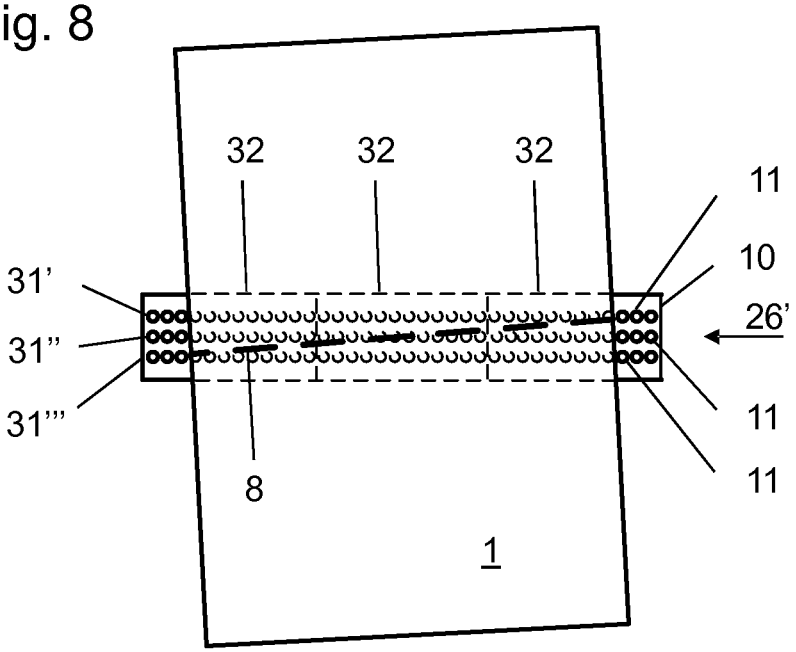
FIG. 8 A view of a different exemplary embodiment which functions in a similar manner as the one according to FIG. 7, but with exit openings arranged in three rows on the compressed air device and a print sheet for folding that has been supplied in a twisted position.

Alternative to the solution according to FIG. 7, a different exemplary embodiment is shown in FIG. 8, for which the compressed air device 10 is also provided with three segments 32, having three rows 31', 31" 31'" of exit openings 11 which extend parallel to the folding gap 7. In contrast to the exemplary embodiment shown in FIG. 7, if an offset of the print sheet 1 to be folded in the guide plane 3 is detected with the aid of sensors, not shown herein, the compressed air device 10 need not be displaced and/or pivoted in an orientation plane 39 for adapting the position of the exit openings 11. Rather, a corresponding triggering of the exit openings 11 in the respective rows 31', 31" and 31'" which are admitted segment-by-segment and parallel to the folding gap 7 with compressed air 12 is sufficient to correct the offset. The offset of the print sheet 1 that is shown in FIG. 8 can be corrected, for example, by triggering the exit openings 11 in the first row 31' of the upstream arranged segment 32, the exit openings 11 arranged in the second row 31" of the center segment 32, and the exit openings 11 in the third row 31'" of the downstream arranged segment 32 with the aid of compressed air 12. To realize this solution, the exit openings 11 in the compressed air device 10 could, of course, also be arranged in two rows 31 or in more than three rows, which are respectively oriented parallel to the folding gap 7 and could also be arranged in more than three segments 32.

For all exemplary embodiments and to improve the folding quality, in particular to avoid dog ears in the folded print sheets 1, 1', 1" as a result of the blast of compressed air 12', at least one second compressed air blast 12" can be directed toward the same print sheet 1 (see FIGS. 1, 2, 4 and 6*a* to 6*c*), for which the pressure and/or the time interval is preferably selected to be different as compared to the first compressed air blast. As a result, the folding quality of the print sheet can be improved further.

It will be understood that the above description of the present invention is susceptible to various modifications, changes and adaptations, and the same are intended to be comprehended within the meaning and range of equivalents of the appended claims.

What is claimed is:

1. An apparatus for folding print sheets, comprising:

at least one first guide element defining a guide plane in which the print sheet is made available in a folding position;

at least two folding rollers, arranged on a first side of the guide plane and respectively provided with one rotational axis wherein a folding gap is defined between the at least two folding rollers for the print sheet to be folded, wherein the rotational axes are oriented parallel to each other and essentially parallel to the guide plane;

a compressed air source;

a control unit;

a compressed air device, arranged essentially parallel to the rotational axes of the folding rollers on a second side of the guide plane which is essentially arranged opposite the first side of the guide plane, in a region of the folding gap, wherein the compressed air device is connected to the compressed air source and to the control unit, and includes at least one exit opening for the compressed air that is focused onto the folding gap; and control elements connected to the compressed air source and to the control unit, wherein the control elements are activateable by the control unit, so that (1) the time interval during which the at least one exit opening is admitted with the compressed air, (2) the cross-sectional surface of the at least one exit opening, and (3) the pressure of the compressed air supplied to the at least one exit opening are changeable to adapt to properties of the available print sheet.

2. The apparatus according to claim 1, wherein the at least one exit opening of the compressed air device comprises:

at least two first exit openings with identically large cross-sectional surfaces and at least two second exit openings with identically large cross-sectional surfaces that differ in size from the cross-sectional surfaces of the first exit openings;

wherein the control elements include: at least one control element and at least one different control element for changing the time interval during which the exit openings are admitted with compressed air and for changing the cross-sectional surfaces of the exit openings, wherein the first exit openings are connected to the one control element and the second exit openings are connected to the other control element; and at least one additional control element connected to the exit openings for changing a pressure of the compressed air that is supplied to the exit openings.

3. The apparatus according to claim 1, further comprising a feeding device having a first feeding direction that extends essentially at a right angle to the rotational axes of the folding rollers or a second feeding direction that extends essentially parallel to the rotational axes of the folding rollers.

4. The apparatus according to claim 3, wherein the compressed air device comprises at least two segments arranged side-by-side in the first feeding direction or arranged one behind the other in the second feeding direction, each segment including at least one exit opening having a cross-sectional surface, wherein each segment is connected to the compressed air source and the control unit, and includes at least one of the control elements, wherein the two segments are arranged to be activated separately with compressed air.

5. The apparatus according to claim 4, wherein the at least one control element of each segment comprises respectively at least one of: (a) at least one first control element for changing the time interval during which the at least one exit opening is admitted with compressed air, (b) at least one second control element for changing the cross-sectional surface of the exit opening, and (c) at least one third control element for changing the pressure of the compressed air supplied to the exit opening.

6. The apparatus according to claim 3, wherein the feeding device comprises the feeding device having the second feeding direction, and the folding position includes at least one first and one second folding position arranged spaced apart in the second feeding direction; and further comprising at least first and second removal sections arranged downstream of the folding rollers, wherein the first removal section is adapted to accommodate at least one print sheet located in the first folding position and the second removal section is adapted to accommodate at least one print sheet located in the second folding position.

7. The apparatus according to claim 3, wherein the feeding device comprises the feeding device having the second feeding direction, and the folding position includes at least one first and one second folding position arranged in the guide plane, one behind the other, in the second feeding direction, the folding positions being arranged overlapping, the apparatus further comprising a joint removal section arranged downstream of the folding rollers and arranged to accommodate overlapping in the feeding direction at least one print sheet located in the first folding position and at least one print sheet located in the second folding position.

8. The apparatus according to claim 3, wherein the feeding device comprises the feeding device having the second feeding direction, and further including at least one first and at least one second end stop arranged in the guide plane, wherein the second end stop is arranged in the second feeding direction upstream of the first end stop, and wherein both end stops are liftable above the guide plane and are lowerable below the guide plane.

9. The apparatus according to claim 1, further comprising at least one second guide element for the print sheet arranged between the at least one first guide element and the compressed air device, wherein the at least one second guide element extends up to an immediate region of the at least one exit opening of the compressed air device.

10. The apparatus according to claim 1, wherein the compressed air device has an orientation plane extending parallel and at a distance to the guide plane, and the compressed air device is arranged in the orientation plane to be displaceable and pivotal.

11. A method for folding print sheets, comprising:

making available a print sheet to a folding position located in a guide plane adjacent a folding gap between two rotating folding rollers located on one side of the guide plane and having respectively one rotational axis, wherein the rotational axes are oriented parallel to each other and parallel to the guide plane;

admitting the print sheet in the region of the folding gap with a compressed air blast from a second side of the guide plane that is located opposite the first side, the compressed air blast coming from a compressed air device connected with a compressed air source and a control unit, the compressed air device having at least one exit opening with a cross-sectional surface for the compressed air that is focused onto the folding gap, the admitting including changing, with aid of the control unit, at least one of (a) a time interval during which the at least one exit opening of the compressed air device is admitted with compressed air, (b) a cross-sectional surface of the at least one exit opening and (c) the pressure of the compressed air supplied to the exit opening, to adapt the compressed air blast to properties of the available print sheet, wherein the print sheet is transported under the effect of the compressed air blast out of the guide plane and to the rotating folding rollers; and folding the print sheet on the first side of the guide plane between at least the two rotating folding rollers.

12. The method according to claim 11, wherein the compressed air device includes at least two first exit openings having identically large cross-sectional surfaces and at least two second exit openings with identically large cross-sectional surfaces that differ in size from the cross-sectional surfaces of the at least first two exit openings, wherein the method further comprises:

changing the time interval for admitting the first and the second exit openings with compressed air and the cross-sectional surfaces of the exit openings by selectively activating the first exit openings with the aid of one control element and the second exit openings with the aid of another control element; and selectively changing the pressure of the compressed air that is supplied to the exit openings with the aid of at least one additional control element that is coupled to the exit openings.

13. The method according to claim 11, including one of supplying the print sheet in a first feeding direction, essentially extending at a right angle to the rotational axes of the folding rollers or in a second feeding direction which essentially extends parallel to the rotational axes of the folding rollers.

14. The method according to claim 13, wherein the compressed air device comprises at least two segments, arranged side-by-side in the first feeding direction or one behind the other in the second feeding direction, and the segments include respectively at least one exit opening with a cross-sectional surface, wherein the method further includes activating each segment separately with compressed air and triggering with the control unit a blast of compressed air, modified according to the properties of the print sheet, from the at least one exit opening of at least one of the segments of the compressed air device and directed onto the available print sheet.

15. The method according to claim 13, wherein the compressed air device is disposed in an orientation plane that is parallel to and spaced from the guide plane, and the method further includes at least one of displacing and pivoting the compressed air device in the orientation plane in order to compensate for a print sheet that is supplied while displaced and/or twisted, relative to the feeding direction.

16. The method according to claim 13, wherein the step of making the print sheet available includes making the print sheet available in one of at least two folding positions, arranged one behind the other in the second feeding direction, selecting the respective folding position corresponding to a specified production order, directing the compressed air blast only toward the print sheet in the selected folding position, and accommodating the print sheet after the folding operation in one of at least two removal sections.

17. The method according to claim 13, wherein the step of making the print sheet available includes making at least two successively following, spaced apart print sheets available in a respectively other one of at least two folding positions, arranged successively and spaced-apart in the second feeding direction, selecting the respective folding position based on a specified production order, directing the compressed air blast, in each case, only toward the print sheet available in the selected folding position, and accommodating, after the folding operation, the print sheet in a respectively other one of at least two removal sections.

18. The method according to claim 13, wherein the step of making the print sheet available includes making available at least two successively following print sheets while positioned overlapping in a respectively other one of at least two folding positions arranged one behind the other in the second feeding direction, selecting the respective folding position according to a specified production order, directing the compressed air blast only onto the print sheet in the folding position, and accommodating, after the folding operation, the print sheets overlapping in a joint removal section.

19. The method according to claim 11, wherein the compressed air blast constitutes a first compressed air blast, and the method further comprises directing at least a second compressed air blast toward the same print sheet following the first compressed air blast, the directing step including changing at least one of the pressure and time interval for the second compressed air blast relative to the first compressed air blast.

20. The method according to claim 11, including suppressing the compressed air blast that is focused onto an available print sheet and conveying said available print sheet out of the guide plane.

* * * * *